US011712884B2

(12) United States Patent
Brocker et al.

(10) Patent No.: US 11,712,884 B2
(45) Date of Patent: Aug. 1, 2023

(54) SCREEN-PRINTING CYLINDER

(71) Applicant: Gallus Ferd. Rueesch AG, St. Gallen (CH)

(72) Inventors: Heinz Brocker, Herisau (CH); Roland Greutmann, Speicherschwendi (CH); Hans-Rudolf Frick, Herisau (CH)

(73) Assignee: Gallus Ferd. Rueesch AG, St. Gallen (CH)

( * ) Notice: Subject to any disclaimer, the term of this patent is extended or adjusted under 35 U.S.C. 154(b) by 0 days.

(21) Appl. No.: 17/903,221

(22) Filed: Sep. 6, 2022

(65) Prior Publication Data

US 2023/0001685 A1 Jan. 5, 2023

Related U.S. Application Data

(63) Continuation of application No. 17/078,831, filed on Oct. 23, 2020.

(30) Foreign Application Priority Data

Oct. 25, 2019 (DE) ..... 10 2019 216 458.7

(51) Int. Cl.
*B41F 15/38* (2006.01)

(52) U.S. Cl.
CPC ..... *B41F 15/38* (2013.01)

(58) Field of Classification Search
CPC ..... B41F 15/38; B41F 15/0809
USPC ..... 101/116, 118
See application file for complete search history.

(56) References Cited

U.S. PATENT DOCUMENTS

| | | | | |
|---|---|---|---|---|
| 4,587,900 | A | 5/1986 | Oshio | B41L 29/02 101/389.1 |
| 4,813,356 | A | 3/1989 | Abendroth | B41F 27/1231 101/415.1 |
| 4,911,069 | A | 3/1990 | Hayama et al. | |
| 5,655,445 | A | 8/1997 | Brocker et al. | |
| 5,671,671 | A | 9/1997 | Wyssmann et al. | |
| 5,878,660 | A | 3/1999 | Takahashi | B41L 13/06 101/127 |
| 5,960,716 | A | 10/1999 | Schaede | |
| 6,457,410 | B1 | 10/2002 | Zerillo | B41F 7/18 101/415.1 |
| 6,485,777 | B1 | 11/2002 | Riedener et al. | |
| 6,681,690 | B2 | 1/2004 | Schaede | |

(Continued)

FOREIGN PATENT DOCUMENTS

| | | | |
|---|---|---|---|
| DE | 2324330 | A1 | 12/1974 |
| DE | 3903721 | A1 | 8/1989 |

(Continued)

OTHER PUBLICATIONS

English translation of JP 2007-105995 A, publication date Apr. 2007. (Year: 2007).*

(Continued)

*Primary Examiner* — Leslie J Evanisko
(74) *Attorney, Agent, or Firm* — Laurence A. Greenberg; Werner H. Stemer; Ralph E. Locher

(57) ABSTRACT

A screen-printing cylinder includes a cylinder shell and one or more flexible surface elements on the cylinder shell. The one or more flexible surface elements are at least one of resilient or springy, and the one or more flexible surface elements are elliptical patches or circular patches. The flexible surface elements give way upon contact with sheet grippers projecting from an impression cylinder, so that it is not necessary to move the screen-printing cylinder out to avoid contact with the sheet grippers.

2 Claims, 5 Drawing Sheets

(56) References Cited

U.S. PATENT DOCUMENTS

| | | | | |
|---|---|---|---|---|
| 2005/0150401 | A1* | 7/2005 | Nakamura | B41F 13/10 101/116 |
| 2007/0044671 | A1 | 3/2007 | Knabe | B41F 21/10 101/246 |
| 2007/0193456 | A1 | 8/2007 | Aoki | B41F 15/38 101/119 |

FOREIGN PATENT DOCUMENTS

| | | | | |
|---|---|---|---|---|
| DE | 20018616 | U1 | 2/2001 | |
| DE | 102009017686 | A1 | 10/2010 | |
| EP | 581606 | A1 | 2/1994 | B41L 13/06 |
| EP | 0711660 | A1 | 5/1996 | |
| EP | 0723864 | A1 | 7/1996 | |
| EP | 0816072 | A1 | 1/1998 | |
| JP | 08002083 | A * | 1/1996 | |
| JP | 2001270213 | A * | 10/2001 | |
| JP | 2007105995 | A * | 4/2007 | |
| WO | 9729912 | A1 | 8/1997 | |
| WO | 9948690 | A1 | 9/1999 | |
| WO | 0154907 | A1 | 8/2001 | |

OTHER PUBLICATIONS

English translation of JP H082083 A, publication date Jan. 1996. (Year: 1996).*

English translation of JP 2001-270213 A, publication date Oct. 2001. (Year: 2001).*

* cited by examiner

SCREEN-PRINTING CYLINDER

CROSS-REFERENCE TO RELATED APPLICATION

This application is a Continuation of U.S. application Ser. No. 17/078,831, filed Oct. 23, 2020. This application also claims the priority, under 35 U.S.C. § 119, of German Patent Application DE 10 2019 216 458, filed Oct. 25, 2019; the prior applications are herewith incorporated by reference in their entirety.

BACKGROUND OF THE INVENTION

Field of the Invention

The present invention relates to a screen-printing cylinder.

In the printing industry, the printing method of rotary screen printing has been widely used. In rotary screen printing, a screen-printing cylinder usually interacts with an impression cylinder to form a printing gap. Through the use of a doctor blade, the printing medium, for example printing ink, is applied to the printing material through the screen-printing cylinder. In rotary screen printing, many different printing materials can be printed, for example textiles, carpets, paper, board and films. Rotary screen printing is used firstly during continuous printing, in which the material to be printed is transported from roll to roll. One important use of continuous rotary screen printing is the printing of labels. Secondly, rotary screen printing is also used in sheet-fed printing machines, in which the material to be printed is not fed to the printing machine continuously from roll to roll but in the form of individual sheets to be printed.

In rotary screen printing on sheet-fed printing machines, the impression cylinder normally has a gripper system having one or more sheet gripper(s), which entrain the individual sheets and guide them past the screen-printing cylinder. In order to avoid the gripper system of the impression cylinder, which normally projects out of the cylinder shell of the impression cylinder, colliding with the screen-printing cylinder, different solutions have been proposed in the prior art. Firstly, it is known to periodically move out the screen-printing cylinder together with the doctor blade, i.e. to increase the distance from the impression cylinder, in order to create space for the elevated gripper system. Secondly, it is proposed to countersink the gripper system in the impression cylinder.

European Patent Application EP 0 723 864 A1, corresponding to U.S. Pat. No. 5,671,671, describes a rotary screen-printing machine for sheet-fed printing having an impression cylinder which has a cylinder groove in which the sheet gripper is countersunk.

International Publication WO 99/48690, corresponding to U.S. Pat. No. 6,485,777, describes a rotary screen-printing process for printing sheets, in which the sheets are guided through a coating section by using grippers.

International Publication WO 01/54907 A1, corresponding to U.S. Pat. No. 6,681,690, describes a sheet-fed printing machine having two screen-printing cylinders for printing on both sides of a printing material, wherein at least one of the screen-printing cylinders has a holding device for the sheet-shaped printing materials, and at least one of the screen-printing cylinders has an indentation on its circumferential surface as a counterpart to the holding device.

The prior art devices are associated with disadvantages. The regular movement in and out of a screen-printing cylinder and a doctor blade must be coordinated precisely with the screen-printing cylinder, the doctor blade and the impression cylinder. The simultaneous movement in and out of the screen-printing cylinder and the doctor blade is demanding mechanically and in terms of control, can limit the printing speed and leads to a higher requirement for maintenance of the components involved. Countersinking the gripper system in the impression cylinder places increased requirements on the gripper mechanism, so that it is often not possible for the comparatively robust and economical grippers used in elevated gripper systems to be used. One undesired effect of countersunk gripper systems is increased creasing of the guided sheet. That can lead to problems in the transfer of the sheet to the next driver roll and when stacking the finished printed sheets.

BRIEF SUMMARY OF THE INVENTION

It is accordingly an object of the invention to provide a screen-printing cylinder, which overcomes the hereinafore-mentioned disadvantages of the heretofore-known cylinders of this general type. A printing system should include a screen-printing cylinder and an impression cylinder having an elevated gripper system for rotary screen printing of sheet-shaped printing materials which avoids the disadvantages of the prior art. The printing system should also be compatible with conventional impression cylinders having an elevated gripper system and not require the screen-printing cylinder to be moved in and out frequently. Intensified creasing of the guided sheet should be avoided.

Surprisingly, it has been found that, in a printing system including a screen-printing cylinder and an impression cylinder having an elevated sheet gripper system, it is not necessary to move out the screen-printing cylinder before contact with the elevated sheet gripper system of the impression cylinder if the contact points of the screen-printing cylinder with the sheet gripper system of the impression cylinder are provided with a resilient and/or springy surface element.

The printing system according to the invention makes it possible to use conventional impression cylinders having an elevated gripper system and places lower requirements on the control and mechanism of the cylinders. Moving the screen-printing cylinder in and out frequently is avoided. The wear and the requirement for maintenance of the components involved are reduced. No undesired creasing of the guided sheet during transport through the printing gap occurs. Printed results of high optical quality are obtained.

With the foregoing and other objects in view there is provided, in accordance with the invention, a printing system for rotary screen printing, comprising a screen-printing cylinder and an impression cylinder interacting with the screen-printing cylinder, the impression cylinder having one or more surface element(s) projecting out of its cylinder shell, and the screen-printing cylinder having one or more flexible surface element(s) on its cylinder shell which interact with the one or more surface element(s) projecting out of the cylinder shell of the impression cylinder.

In a preferred embodiment, the one or more surface element(s) projecting out of the cylinder shell of the impression cylinder are one or more sheet gripper(s).

In a further preferred embodiment, the one or more flexible surface element(s) of the screen-printing cylinder in the printing system according to the invention are configured to be resilient and/or springy.

Within the context of the present invention, a "flexible surface element" is understood in particular to be a surface element which, under the action of force, can be brought from its original form into a stretched form by an element projecting out of the cylinder shell of the impression cylinder and, when the action of force is ended, returns from this stretched form into its original form again. The one or more flexible surface element(s) are preferably configured to be resilient and/or springy. In a particularly preferred embodiment, the one or more surface element(s) are configured to be resilient.

If the flexible surface element is configured to be resilient, it includes at least one resilient material, preferably one or more plastic(s), particularly preferably one or more elastomer(s). Very particularly preferred are vulcanized natural and synthetic rubbers; specifically, it is rubber. If the flexible surface element is configured to be springy, it preferably includes one or more flat spring(s).

The present invention also relates to a screen-printing cylinder which advantageously can be used in the printing system according to the invention.

Accordingly, the present invention also relates to a screen-printing cylinder for rotary screen printing which includes one or more flexible surface element(s) on its cylinder shell.

In a preferred embodiment, the one or more flexible surface element(s) of the screen-printing cylinder according to the invention are configured to be resilient and/or springy. Preferred materials for the flexible surface elements are those cited as preferred above.

In a further preferred embodiment, the one or more flexible surface element(s) of the screen-printing cylinder according to the invention are configured as elliptical patches, particularly preferably as circular patches.

In a further preferred embodiment, the screen-printing cylinder according to the invention includes multiple flexible surface elements, which are disposed in a row parallel to the cylinder axis of the screen-printing cylinder. In this embodiment, the screen-printing cylinder preferably includes 2, 3, 4, 5 or 6 flexible surface elements, particularly preferably 3, 4 or 5 flexible surface elements.

The present invention also relates to a method for producing a screen-printing cylinder having one or more flexible surface element(s) on its cylinder shell, comprising the following steps:

a) providing a sheet-shaped screen-printing cylinder material, b) if necessary, producing one or more openings in the sheet-shaped screen-printing cylinder material, c) fixing a flexible material to the sheet-shaped screen-printing cylinder material and/or in the one or more opening(s) of the sheet-shaped screen-printing cylinder material, and d) fixing the sheet-shaped screen-printing cylinder material in a cylindrical form, obtaining the screen-printing cylinder.

The screen-printing cylinder material provided in step a) is generally an already imaged screen-printing cylinder material. In principle, the production of the openings in step b) can, however, be carried out in a not yet imaged screen-printing cylinder material, the imaging of the screen-printing cylinder material then as a rule being carried out before or after step c), specifically after the steps a) and possibly b) and before step c) or after step c) and before step d). The imaging can be carried out in accordance with methods known in principle from the prior art and, as a rule, includes the steps of exposing, washing out and drying. Suitable screen-printing cylinder materials are commercially obtainable, for example under the trade name Screeny® from Gallus Ford, Rüesch A G, St. Gallen Switzerland. The production of the openings in step b) can be carried out by the methods known in principle to those skilled in the art, for example by punching, laser cutting or mechanical cutting. The fixing of the flexible material in step c) can be carried out by methods known in principle, for example by adhesive bonding. The fixing of the sheet-shaped screen-printing cylinder material in cylindrical form in step d) can be carried out by methods known in principle to those skilled in the art, for example with the aid of a welding device.

The present invention also relates to a printing machine for rotary screen printing, including one or more printing system(s) according to the invention.

The present invention also relates to the use of a screen-printing cylinder having one or more flexible surface element(s) on its cylinder shell in a rotary screen-printing process.

Other features which are considered as characteristic for the invention are set forth in the appended claims.

Although the invention is illustrated and described herein as embodied in a screen-printing cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
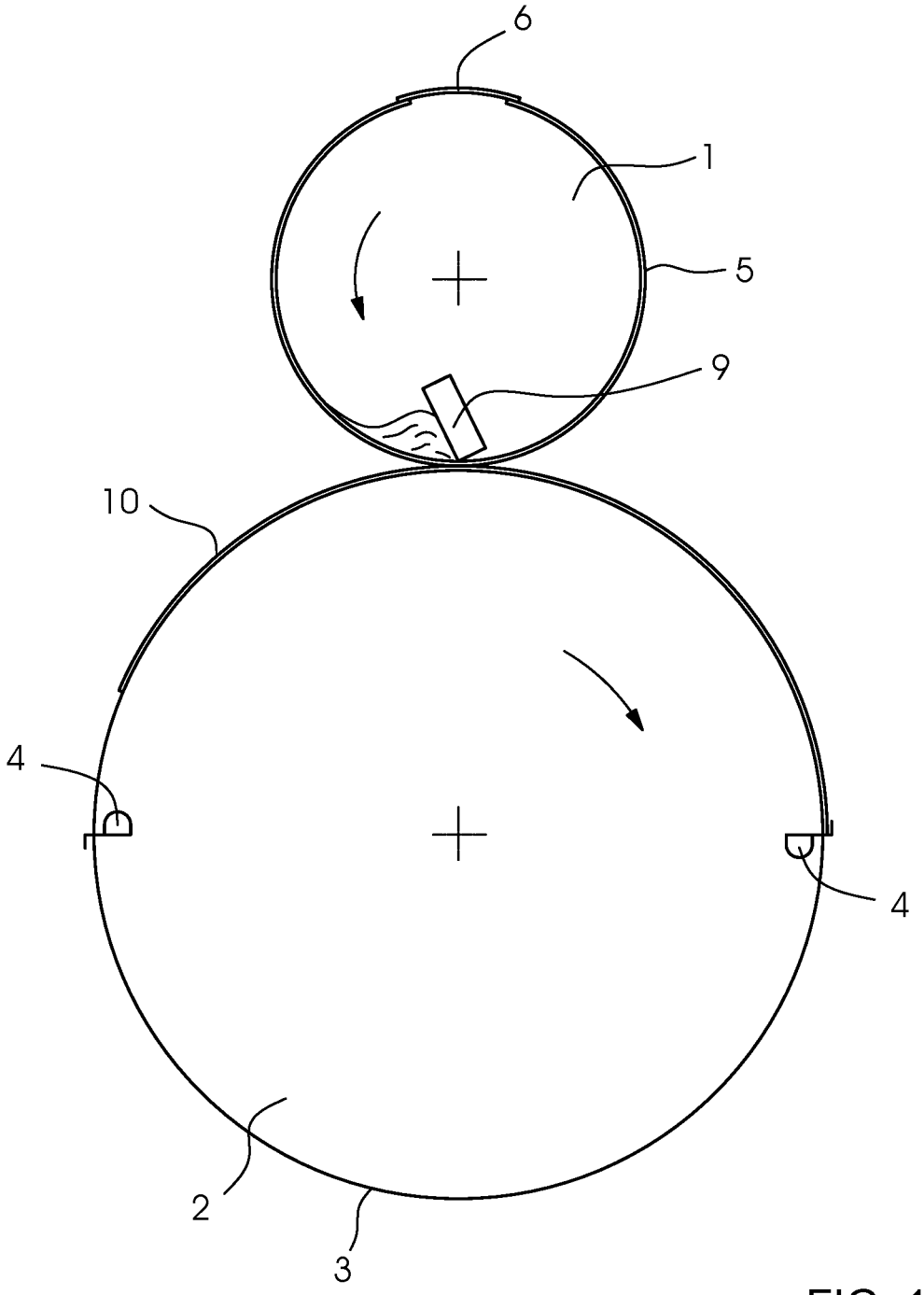
FIGS. 1 and 2 are diagrammatic, cross-sectional views of a screen-printing cylinder and an impression cylinder of a printing system according to the invention.

Referring now to the figures of the drawings in detail and first, particularly, to FIG. 1 thereof, there is seen a printing system according to the invention. A screen-printing cylinder 1 of the printing system has four flexible surface elements 6, which are disposed in a row parallel to the cylinder axis of the screen-printing cylinder 1 (as seen from the side). An impression cylinder 2 of the printing system transports a sheet 10 of printing material, for example paper, which is held firmly by a pair of sheet grippers 4 projecting out of its cylinder shell 3. A doctor blade 9 has not yet been moved out. The screen-printing cylinder 1 and the impression cylinder 2 are coordinated with each other in such a way that during the continuous rotation of the two cylinders 1, 2 the flexible surface elements 6 of the screen-printing cylinder 1 come to lie exactly over the two pairs of the sheet grippers 4 of the impression cylinder 2.

Figure 2:
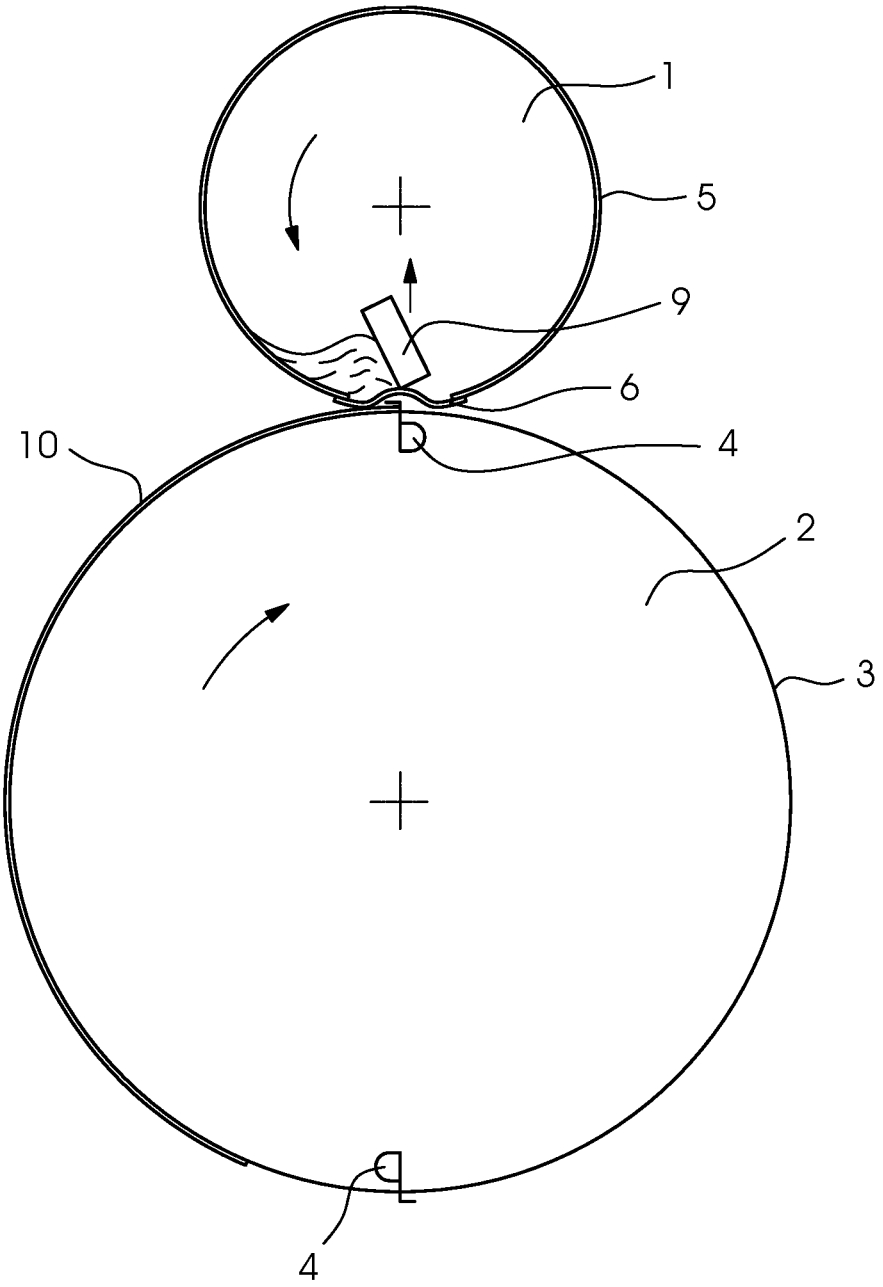

FIG. 2 shows the same printing system as in FIG. 1, in which the sheet-guiding pair of sheet grippers 4 and the flexible surface elements 6 come into contact with one another. The doctor blade 9 has been moved out. Due to the flexible property of the surface elements 6, the surface elements 6 are curved inward upon contact with the pair of sheet grippers 4. After the end of the contact, the surface elements 6 curve back into their starting position again (not illustrated in FIG. 2).

Figure 3:
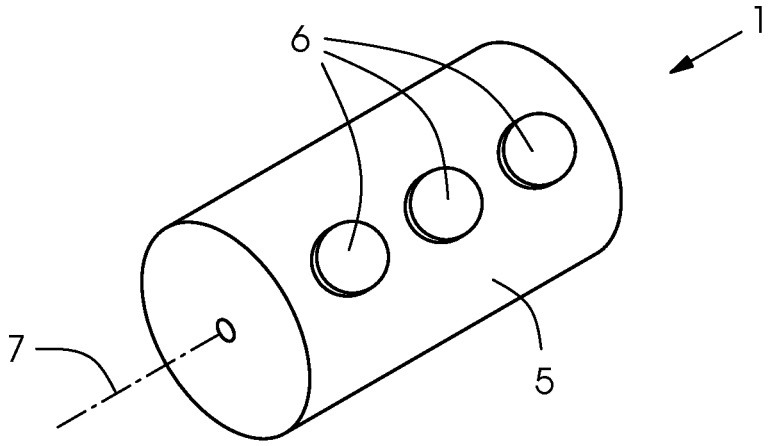
FIGS. 3 and 4 are perspective views of a screen-printing cylinder.

FIG. 3 shows a screen-printing cylinder 1 according to the invention. The screen-printing cylinder 1 has three flexible surface elements 6 on its cylinder shell 5. The surface elements 6 are disposed in a row parallel to a cylinder axis 7 of the screen-printing cylinder 1.

Figure 4:
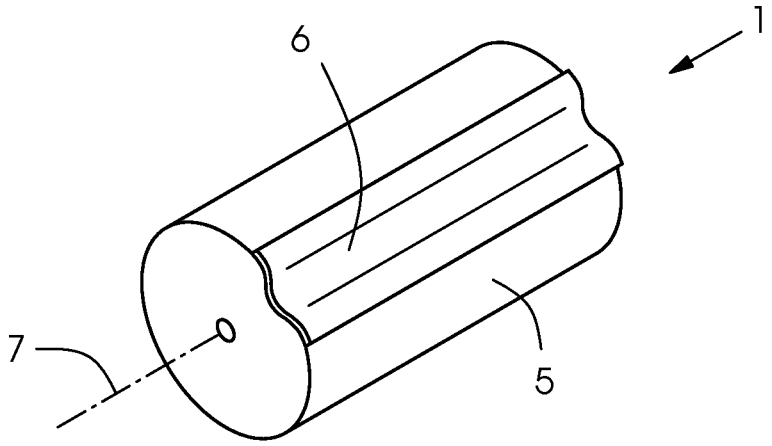

FIG. 4 shows a screen-printing cylinder 1 according to the invention which has only one flexible surface element 6, which extends over the entire cylinder length.

Figure 5A:
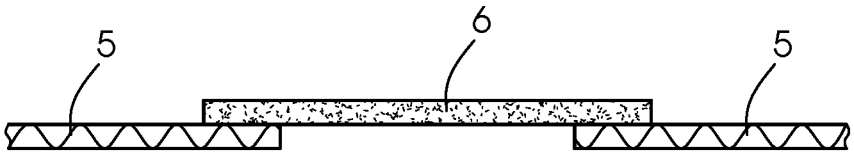
FIGS. 5A, 5B and 5C are enlarged, fragmentary, cross-sectional views of flexible surface elements on a cylinder shell.

FIG. 5 shows various possible ways of fixing a flexible material on the sheet-shaped screen-printing cylinder material or in the openings of the sheet-shaped screen-printing cylinder material in step c) of the method according to the invention. In a variant shown in FIG. 5A, the flexible material of the surface elements 6 is fixed, for example by adhesive bonding, to the edges of the openings of the sheet-shaped screen-printing cylinder material, which later forms the cylinder shell 5.

Figure 5B:
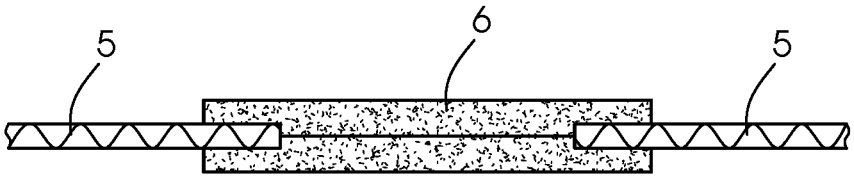

In a variant shown in FIG. 5B, a flexible material of the surface element 6 is additionally fixed to the sheet-shaped screen-printing cylinder material from the other side.

Figure 5C:
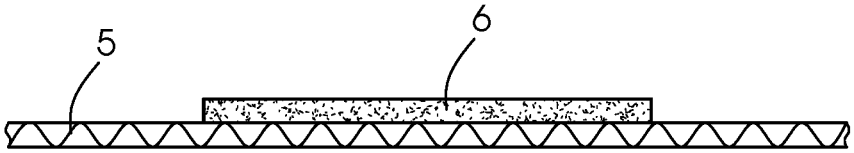

In a variant shown in FIG. 5C, no opening is produced in the sheet-shaped screen-printing cylinder material. In this embodiment, the flexible material of the surface element 6 is fixed directly to the sheet-shaped screen-printing cylinder material, for example by adhesive bonding.

LIST OF DESIGNATIONS

1 Screen-printing cylinder
2 Impression cylinder
3 Cylinder shell of the impression cylinder
4 Sheet grippers
5 Cylinder shell of the screen-printing cylinder
6 Flexible surface element
7 Cylinder axis of the screen-printing cylinder
9 Doctor blade
10 Sheet

The invention claimed is:

1. A screen-printing cylinder for rotary screen printing, the screen-printing cylinder comprising:

a cylinder shell and one or more flexible surface elements on said cylinder shell;

said one or more flexible surface elements being at least one of resilient or springy and being able to be curved inward of the screen-printing cylinder; and said one or more flexible surface elements being elliptical patches or circular patches.

2. The screen-printing cylinder according to claim 1, which further comprises a cylinder axis, said one or more flexible surface elements including a plurality of flexible surface elements disposed in a row parallel to said cylinder axis.

* * * * *